US009835421B2

(12) United States Patent
Laporte et al.

(10) Patent No.: US 9,835,421 B2
(45) Date of Patent: Dec. 5, 2017

(54) DEVICE FOR LAUNCHING TARGETS FOR SPORT SHOOTING, WITH INSTANTANEOUS TAKE-OFF OF THE TARGET, WITH ACTIVE LOCKING MEANS ON THE LAUNCHING ARM ROTATING SHAFT

(71) Applicant: Laporte Holding, Biot (FR)

(72) Inventors: Jean-Michel Laporte, Biot (FR); Jean-Marc Fouques, Claviers (FR)

(73) Assignee: LAPORTE HOLDING, Biot (FR)

( * ) Notice: Subject to any disclaimer, the term of this patent is extended or adjusted under 35 U.S.C. 154(b) by 0 days.

(21) Appl. No.: 15/110,687

(22) PCT Filed: Jan. 7, 2015

(86) PCT No.: PCT/EP2015/050129

§ 371 (c)(1),
(2) Date: Jul. 8, 2016

(87) PCT Pub. No.: WO2015/104272

PCT Pub. Date: Jul. 16, 2015

(65) Prior Publication Data

US 2016/0327379 A1 Nov. 10, 2016

(30) Foreign Application Priority Data

Jan. 8, 2014 (FR) ..... 14 50123

(51) Int. Cl.
*F41J 9/24* (2006.01)
*F41J 9/20* (2006.01)
*F41J 9/18* (2006.01)

(52) U.S. Cl.
CPC . *F41J 9/24* (2013.01); *F41J 9/18* (2013.01); *F41J 9/20* (2013.01)

(58) Field of Classification Search
CPC ..... F41J 9/18; F41J 9/20; F41J 9/24
(Continued)

(56) References Cited

U.S. PATENT DOCUMENTS 1,475,713 A * 11/1923 Napier ..... F41J 9/24
124/32
2,158,739 A * 5/1939 Bingham, Jr. ..... F41J 9/20
124/36

(Continued)

FOREIGN PATENT DOCUMENTS

DE 2137741 2/1973
FR 2238136 2/1975

OTHER PUBLICATIONS

European Patent Office International Search Report and Written Opinion dated Mar. 30, 2015, for International Application PCT/EP2015/050129, filed Jan. 7, 2015, Applicant, Laporte Holding (9 pages).

*Primary Examiner* — Alexander Niconovich
(74) *Attorney, Agent, or Firm* — McCracken & Gillen LLC

(57) ABSTRACT

The present invention relates to a device for launching targets for sport shooting, with instantaneous take-off of the target which comprises first and second means for locking the rotation of the arm associated with the motor means and cooperating with complementary locking means inserted between the launching means and the arm rotating shaft, with the locking means being so configured as to lock the arm beyond the "zero point" over an angular sector set beforehand according to the direction of rotation of the arm in a launching position and so as to release the arm beyond the launching position, with the launching means expanding so as to execute the rotation for launching the target.

Applications in the field of sport shooting, both rifle shooting or revolver shooting and in archery.

15 Claims, 11 Drawing Sheets

(58) Field of Classification Search
USPC ..... 124/8, 32, 43, 42
See application file for complete search history.

(56) References Cited

U.S. PATENT DOCUMENTS

| | | | | | |
|---|---|---|---|---|---|
| 2,245,258 | A * | 6/1941 | Darrell | F41J 9/20 | 124/8 |
| 2,996,058 | A * | 8/1961 | Ervine | F41J 9/30 | 124/43 |
| 3,097,635 | A * | 7/1963 | Freeman | F41J 9/30 | 124/43 |
| 3,470,860 | A * | 10/1969 | Kane | F41J 9/20 | 124/34 |
| 3,923,033 | A * | 12/1975 | Laporte | F41J 9/24 | 124/32 |
| 3,971,357 | A * | 7/1976 | LaPorte | F41J 9/24 | 124/32 |
| 5,249,563 | A * | 10/1993 | Patenaude | F41J 9/30 | 124/46 |
| 5,937,839 | A * | 8/1999 | Nilsson | F41J 9/24 | 124/8 |
| 6,176,229 | B1 * | 1/2001 | Patenaude | F41B 3/04 | 124/8 |
| 2006/0065258 | A1 * | 3/2006 | Lovell | F41J 9/30 | 124/9 |
| 2015/0168108 | A1 * | 6/2015 | Laporte | F41J 9/20 | 124/7 |

* cited by examiner

DEVICE FOR LAUNCHING TARGETS FOR SPORT SHOOTING, WITH INSTANTANEOUS TAKE-OFF OF THE TARGET, WITH ACTIVE LOCKING MEANS ON THE LAUNCHING ARM ROTATING SHAFT

The present invention relates to a device for launching targets for sport shooting, with instantaneous take-off of the target, with active locking means on the launching arm rotating shaft, i.e., with the fastest possible launching of the target once the order to launch has been given.

It is particularly applicable to the field of training for target shooting whether using a rifle, a gun or even a bow, especially with a voice-operated launching installation of the trench or skeet type that must react very quickly to the shooter's call.

Targets launching devices for shooting sports are known, with such targets being in the form of clay saucers. One of these devices is disclosed for example in document FR-A-2787181.

Such devices have been satisfactory in general, but are not suitable for some shooting disciplines when an almost instant projection of the target is required, with such projection following the shooter's call, for instance.

Figure 1:
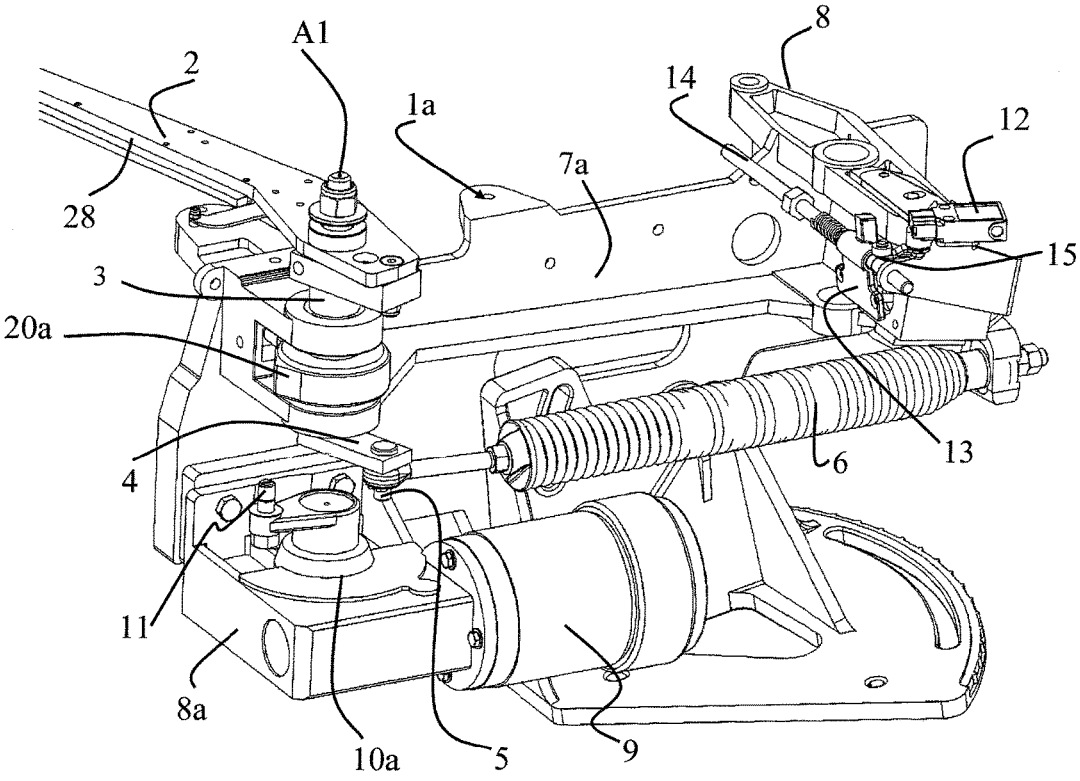

FIG. 1 shows a launching device of the state of the art according to one embodiment enabling an instant start.

According to the launching device 1*a* shown in FIG. 1, a target intended to be launched, not shown in FIG. 1, is projected by a rotating arm 2 provided with a rubber fixture 28. The target is positioned at mid span of the arm 2 against the fixture 28.

The arm 2 is articulated about a substantially vertical axis A1 and is fixed to the upper end of a rotating shaft 3 supported by a crosspiece 7 carried by the upper portion 8 of the device 1*a* body, with said shaft 3 being free to rotate relative to the crosspiece 7 and to the upper portion 8. During the launching operation, the arm 2 rotates about said A1 axis and undergoes angular acceleration which presses the target against the fixture 28 while making the latter roll towards its end. The target is then ejected while spinning around.

The arm 2 is indirectly integral, through the shaft 3, with a connecting rod 4 rotating about the A1 axis, with one end of the connecting rod 4 being linked to the lower end of the shaft 3. At its other opposite end, the connecting rod 4 comprises a nipple 5 positioned on the side of the connecting rod 4 facing away from the arm 2 and protruding downwards. This nipple 5 of the connecting rod 4 is integral with one end of a draw-spring 6, with the other end of the draw-spring 6 being engaged with the upper portion of the device 1*a* body 8. The connecting rod 4 is also mechanically connected to a free wheel 20*a* mounted on the shaft 3.

In the lower part of the device 1*a*, a gear motor 9 is carried by the lower portion 8*a* of the device 1*a* body. This gear motor 9 drives in rotation, through said lower portion 8*a* of the body, a crank pin 10*a* the axis of rotation of which is coaxial with the axis of rotation A1 of the connecting rod 4, the shaft 3 and the arm 2. A nipple 11, protruding above the crank pin 10*a*, is provided on the crank pin 10*a*, and the trajectory of which, during the rotation of the crank pin 10*a*, meets that of the nipple 5 positioned at the end of the connecting rod 4, with such end not being adjacent to the shaft 3. Both nipples 11 and 5 interfere with each other, this advantageously on a height of approximately 3 millimeters.

Located substantially above the attachment of the draw-spring 6 on the upper portion 8 of the device 1*a* body, is provided a contactor 12 which matches the trajectory of one portion of the arm 2 when the latter has rotated about its A1 axis, with such portion being advantageously the end portion of the arm 2.

In such a device 1*a*, the arm 2 rotates about the upper 8 and lower 8*a* portions of the device 1*a* body, with the rotation of the arm 2 being advantageously executed counter-clockwise with the free wheel 20*a*, thus preventing any rotation 7 of the arm 2 in the opposite direction.

To initiate the launching of a target, a remote triggering means commands the gear motor to turn 9. During this step, also called the step of cocking, the crank pin 10 rotates about the pin coaxial with the axis of rotation A1 of the arm 2 and the nipple 11 moves until it comes in contact, advantageously in linear contact, with the nipple 5 carried by the connecting rod 4. The connecting rod 4, the shaft 3 and the arm 2 are then driven in rotation until the arm 2 abuts against the contactor 12. Ideally, this stop is as close as possible to a so-called "zero point" position.

At the <<zero point>>, the arm is not submitted to a torque and thus a balance between the step of cocking and the step of launching is obtained.

While rotating on counter-clockwise, going past the <<zero point>> generates a motor torque on the arm 2 thanks to the tensioned draw-spring 6. If such torque is not hindered by any obstacle, the draw-spring 6 then suddenly expands and the release of the arm 2 causes the launching of the target. During the step of launching by ejecting the target out of the device 1*a*, the arm 2 almost instantly rotates, due to the expanding action of the draw-spring 6. The arm 2 then successively crosses a so-called rest position, at 180° from the "zero point" which it goes beyond due to its inertia until it reaches a position at 270° from the "zero point". This position is maintained by the free wheel 20*a* which prevents any rotation in the opposite direction.

In the device of the prior art, the gear motor 9 is stopped when the arm 2 goes beyond the "zero point" in order to ensure an immediate release upon the order to launch. This position is called the launching position. The balance of the system is then forced and is obtained by adding a moving obstacle on the trajectory of the arm 2. This obstacle consists of a trigger 13 pivoting about a pin 14. The trigger 13 is maintained in contact with an electromagnet rod 15 via a return spring 16.

When the electromagnet 15 is energized, it rotates the trigger 13, thereby releasing the arm 2. This results in an extremely short response satisfactory for the almost instant launching applications.

However, this arrangement has several disadvantages.

A constraint to be considered is the accuracy of the positioning of the contactor 12. If it is activated early, away from the crosspiece 7, the <<zero point>> cannot be gone past, which causes starting being delayed. It is activated late, close to the crosspiece 7, the arm 2 may excessively press the trigger 13 and previously collide with the target placed on the launching plate, which entails a risk of the electromagnet 15 being blocked or the target being damaged. Now, the capacity of the engine to accurately stop in a constant way may vary either with the rise in temperature, or with the voltage. The current adjustment range is about 5 mm in a conventional environment, which is binding.

Besides, using an electromagnet 15 increases the price of the device 1*a* and may generate various failures, even the locking of the device 1*a*. Thus, the electric control which must drive the electromagnet 15 before the gear motor 9 may fail and/or the core of the electromagnet 15 may get stuck, as well as the trigger 13, which raises a problem.

One possible consequence is the trigger 13 being locked in the open position, with the arm 2 thus operating in burst. Human intervention is then required not to launch targets unnecessarily.

Another possible consequence is the locking of the trigger 13 in the closed position. In this case, the gear motor 9 pushes the arm 2 to crush the latter. Human intervention is required to unlock the mechanism. Once the obstacle is released, the arm 2 produces its acceleration by making a rapid rotation on 270°. As a draw-spring 6 commonly used requires 100 to 200 kg to be stretched, the energy released during its expansion is directly proportional to its stiffness. Danger is then real for the repairman and extreme caution is required during the repair operations.

The object of the present invention is to design a target launching device which can have an almost instant response to an order to launch while improving security issues and the cocking time of the devices of the prior art.

For this purpose, the invention provides for a target launching device comprising a rotationally mobile arm, launching means and motor means intended for cocking the arm by rotating said arm and a rotating shaft associated up to a so-called "zero point" position, with the launching means and the motor means acting on said shaft and the launching means being under traction without exerting a torque on said arm in said "zero point" position, characterized in that it comprises first and second means for locking the rotation of the arm associated with the motor means and cooperating with complementary locking means inserted between the launching means and the arm rotating shaft, with the first and second locking means and the complementary locking means being so configured as to lock the arm beyond the "zero point" over an angular sector set beforehand according to the direction of rotation of the arm in a launching position, on the one hand, and so as to release the arm beyond the launching position, with the launching means expanding so as to execute the rotation for launching the target, on the other hand.

The technical effect is an almost instant projection of the target when the motor means substantially go beyond the "zero point" and the first and second locking means become inoperative. The solution provided by the present invention has the advantage of providing a short step of cocking with as short as possible a time for launching the next target upon the shooter's call.

This is obtained using locking means, the action of which directly depends on the motor means, with such locking means being first gradually placed in the locking position by the motor means, which are active when the motor means are stopped, after the launching position has been reached, and then deactivated when the motor means are re-activated and when the arm starts rotating again, away from the launching position. This ensures a safe operation of the device, much higher than the system using a trigger and an electromagnet of the prior art.

Additionally, such a device does not require a very accurate detection of the <<zero point>> position, with such detection being advantageously performed by a detector, i.e. a contactor. The positioning range of the contactor may thus be larger than that of the devices of the prior art. Such positioning tolerance facilitates the adjustment and the positioning of the detector, advantageously a contactor.

Besides, the pressure exerted by the launching means onto the complementary locking means, inserted between the launching means and the arm rotating shaft, participates in the speed of retraction of the second locking means upon release of the arm beyond the launching position.

Besides, as the first and second locking means act on the complementary locking means connected to the arm rotating shaft and not on the arm itself, as is the case for some devices of the prior art, this results in the absence of any mechanical constraint on the arm in the launching device according to the invention.

Eventually, the launching device according to the invention raises no locking risk with respect to the state of the art mentioned in the introduction of this patent application and using a trigger and an electromagnet as the arm locking system.

Optionally, the invention further includes at least any one of the following characteristics, which may be alternative or cumulative:

- the first and second locking means and the complementary locking means are positioned under the arm rotating shaft.
- the launching means are in the form of a draw-spring adapted to be tensioned upon rotation of the arm towards the "zero point" position, with the return of the spring to the expanded position causing the rotation of the arm for enabling the launching of the target by the arm.
- the draw-spring is fixed at one of its ends to an upper portion of the device, with its other end being articulated on one end of a connecting rod, the other end of which is connected to the arm rotating shaft, with the connecting rod carrying the complementary locking means.
- the motor means comprise a gear motor.
- the first and second locking means respectively comprising a first stop pushing the complementary locking means carried by the connecting rod into a position matching the launching position of the arm and a second stop holding such complementary locking means in such position.
- comprising a first crank pin so configured as to be driven by the gear motor and carrying the first stop, a second crank pin mounted on a free wheel and carrying the second stop, with said free wheel allowing the crank pin to rotate in the direction of rotation opposite that of the gear motor.
- the first stop is carried by a first crank pin carried by a first crank pin driven by the gear motor and the second stop is carried by a second free wheel-mounted crank pin, with said free wheel enabling the rotation of the crank pin in the direction of rotation opposite that of the gear motor.
- the first and second crank pins each comprise a first end respectively carrying a pinion and a second end opposite the first end respectively carrying a stop, with the free wheel being arranged at the first end of the second crank pin.
- the pinion of the first crank pin is driven by the gear motor and drives in turn, either directly or indirectly the pinion of the second crank pin.
- comprising an intermediary pinion inserted between the pinion of the first crank pin and the pinion of the second crank pin, with the intermediary pinion being driven by the pinion of the first crank pin and driving the pinion of the second crank pin.
- the second crank pin comprises a rod elastically returned by a spring which pushes the second crank pin against a stationary element, preferably integral with the lower portion of the device body.
- the first stop carried by the first crank pin and the complementary locking means are each in the form of a nipple and the second stop carried by the second crank pin is in the form of a roller.

the device comprises a contactor so positioned as to trigger the stopping of the gear motor once the launching position of the arm has been reached.

the contactor is positioned on the upper portion of the stationary body of the device so as to interact with the free end of the arm carrying a complementary element to the contactor.

The invention also relates to a method for launching a target using such launching device, which method comprises the following successive steps:

cocking the launching means by rotating the arm driven by the motor means to the <<zero point>>, with the first locking means pushing the complementary locking means carried by the arm rotating shaft in a position corresponding to the so-called <<zero point>> position, driving the arm to the launching position beyond the <<zero point>> according to the direction of rotation of the arm, with the first locking means pushing on the complementary locking means carried by the arm rotating shaft in a launching position slightly beyond the <<zero point>> position, stopping the motor means, locking the arm in the launching position, while keeping the launching means under traction, with the second locking means holding the complementary locking means in such position, restarting the motor means, further to an order to launch to unlock the arm and launching of the target by the arm by releasing the launching means further to the release of the complementary locking means by the second locking means.

According to an alternative embodiment, the motor means stop further to the detection of a position of the arm corresponding to the "zero point" or slightly beyond the "zero point" being detected.

Advantageously, the method includes a step of maintaining the arm in its final rotating position after the launch, with said final position being the starting position for the step of cocking a new launching cycle.

Other characteristics, aims and advantages of the present invention will appear upon reading the following detailed description and referring to the appended drawings given as non restrictive examples and wherein:

FIG. 1 is a schematic representation of one known embodiment of the prior art, with a perspective view of a device for launching targets, according to the prior art, FIGS. 2 to 11 are schematic views in perspective, from various angles, of embodiments of a target launching device according to the present invention showing various positions of the launching arm, in such figures.

In the following, a target launching device used in sport shooting such as skeet shooting and thus frequently using clay targets will be described. It should be noted here that the present invention is not limited by such use and that it may relate to the launching of foam targets, for example for archery.

Similarly, targets may also be launched substantially in the air with a significant vertical component or substantially at ground level with a significant horizontal component.

"Carried" means that the two elements are made kinematically integral with one another. All the configurations respecting such kinematic simultaneity fall within the scope of the invention. The two elements may be directly or indirectly connected to each other.

FIG. 1 has already been described in detail in the introduction of this application.

Referring to FIGS. 2 to 11, the target launching device 1 comprises a rotationally mobile launching arm 2, launching means 6 and motor means 9 intended for cocking the arm 2 by rotating said arm 2 and a rotating shaft 3 associated therewith up to a so-called <<zero point>> position, with such position having been specified above. The launching means 6 and the motor means 9 act on said shaft 3 and the launching means 6 are under traction without exerting any torque onto the arm 2 in said <<zero point>> position.

The target launching device 1 comprises first and second means 10, 11, 19, 20, 21 for locking the rotation of the arm 2 associated with the motor means 9 and cooperating with complementary locking means 5 inserted between the launching means 6 and the arm 2 rotating shaft 3. The first and second means 10, 11, 19, 20, 21 and the complementary locking means 5 are so configured as to lock the arm 2 beyond the "zero point" over an angular sector set beforehand according to the direction of rotation of the arm 2 in a launching position, on the one hand, and so as to release the arm 2 beyond the launching position, with the launching means 6 expanding so as to execute the rotation of the arm 2 for launching the target, on the other hand.

The launching position may match the "zero point" position or be taken by the arm just after the latter goes beyond the "zero point" position. The pre-set angular sector depends on the design of the first and second locking means 10, 11, 19, 20, 21, specifically the second locking means 19, 20, 21 which have to ensure an efficient locking of the complementary locking means 5 in the launching position.

In the embodiments of the invention illustrated in the figures, the target launching device 1 uses some characteristics of the device illustrated in FIG. 1, i.e. the arm 2 is indirectly integral, through a rotating shaft 3 associated with the arm 2, with a connecting rod 4 rotating about the axis bearing reference A1 in FIG. 1, with one end of the connecting rod 4 being linked to the lower end of the rotating shaft 3. At its other opposite end, the connecting rod 4 comprises a nipple 5 positioned on the side of the rod facing away from the arm 2 and protruding downwards. This nipple 5 of the connecting rod 4 is engaged onto one end of a draw-spring 6, with the other end of the draw-spring 6 being engaged into the upper portion 8 of the device 1 body, as specifically illustrated in FIG. 11.

In such embodiments of the launching device 1 according to the invention, the nipple 5 represents the complementary locking means whereas the draw-spring 6 illustrates the launching means of the device 1. The draw-spring 6 is adapted to be tensioned upon rotation of the arm 2 towards the "zero point" position thereof, with the return of the draw-spring 6 to the expanded position causing the rotation of the arm 2 for the launching of the target by the arm 2.

Still in the embodiments shown in FIGS. 2 to 11, in the lower part of the device 1, a gear motor 9 illustrating the motor means is carried by the lower portion 8*a* of the device 1*a* body. This gear motor 9 drives in rotation, through said lower portion 8*a*, a first crank pin 10, the axis of rotation of which extends parallel with the axis of rotation of the connecting rod 4 and the arm 2 rotating shaft 3.

Figure 2:
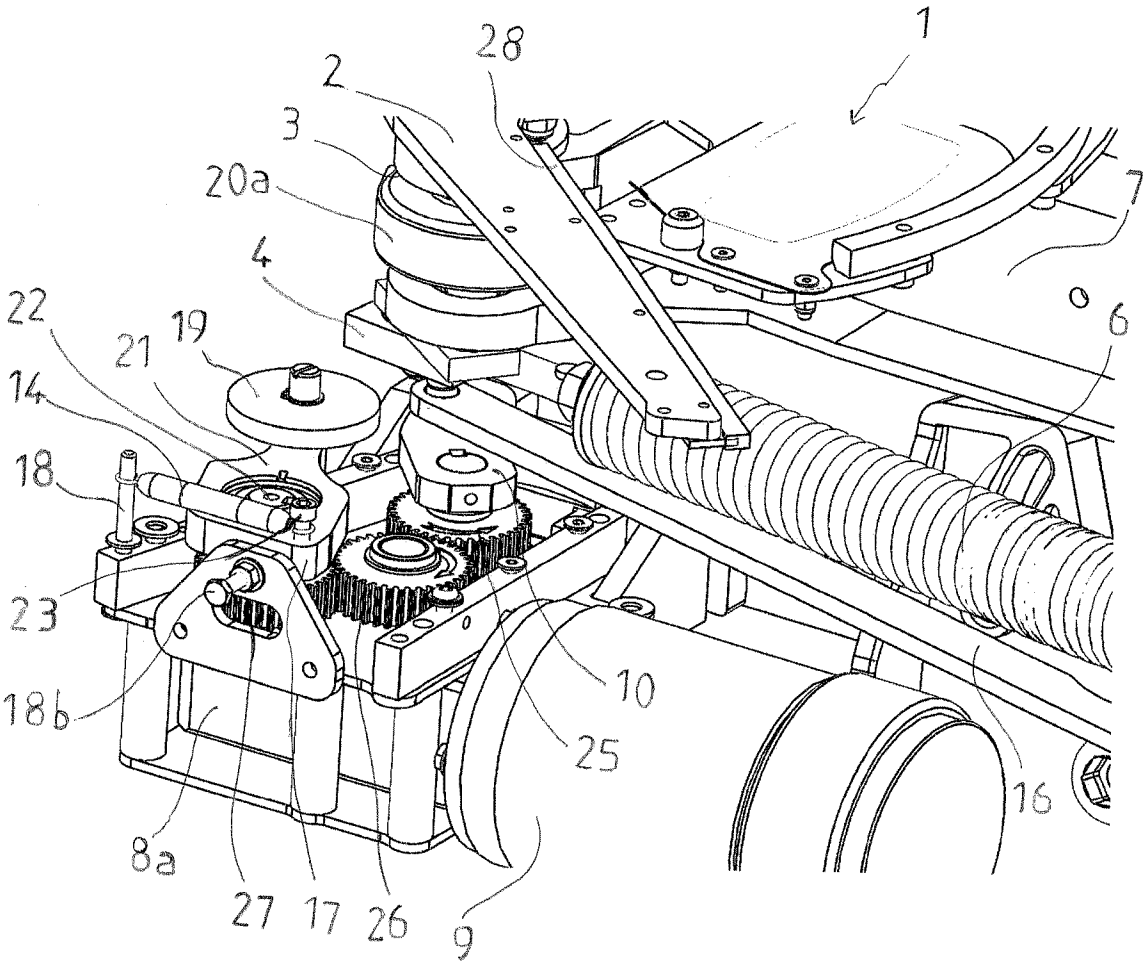
Figure 3:
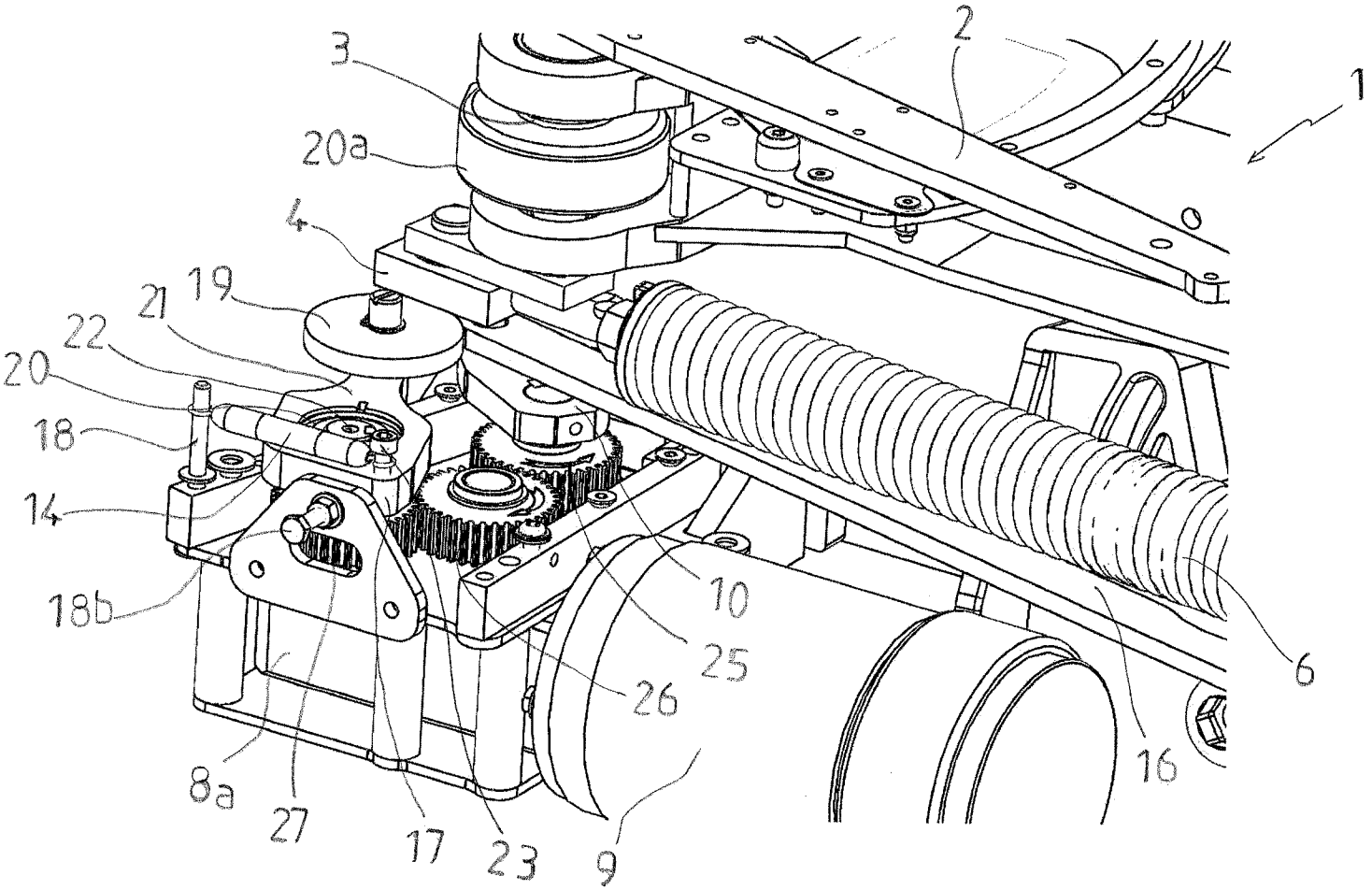
Figure 4:
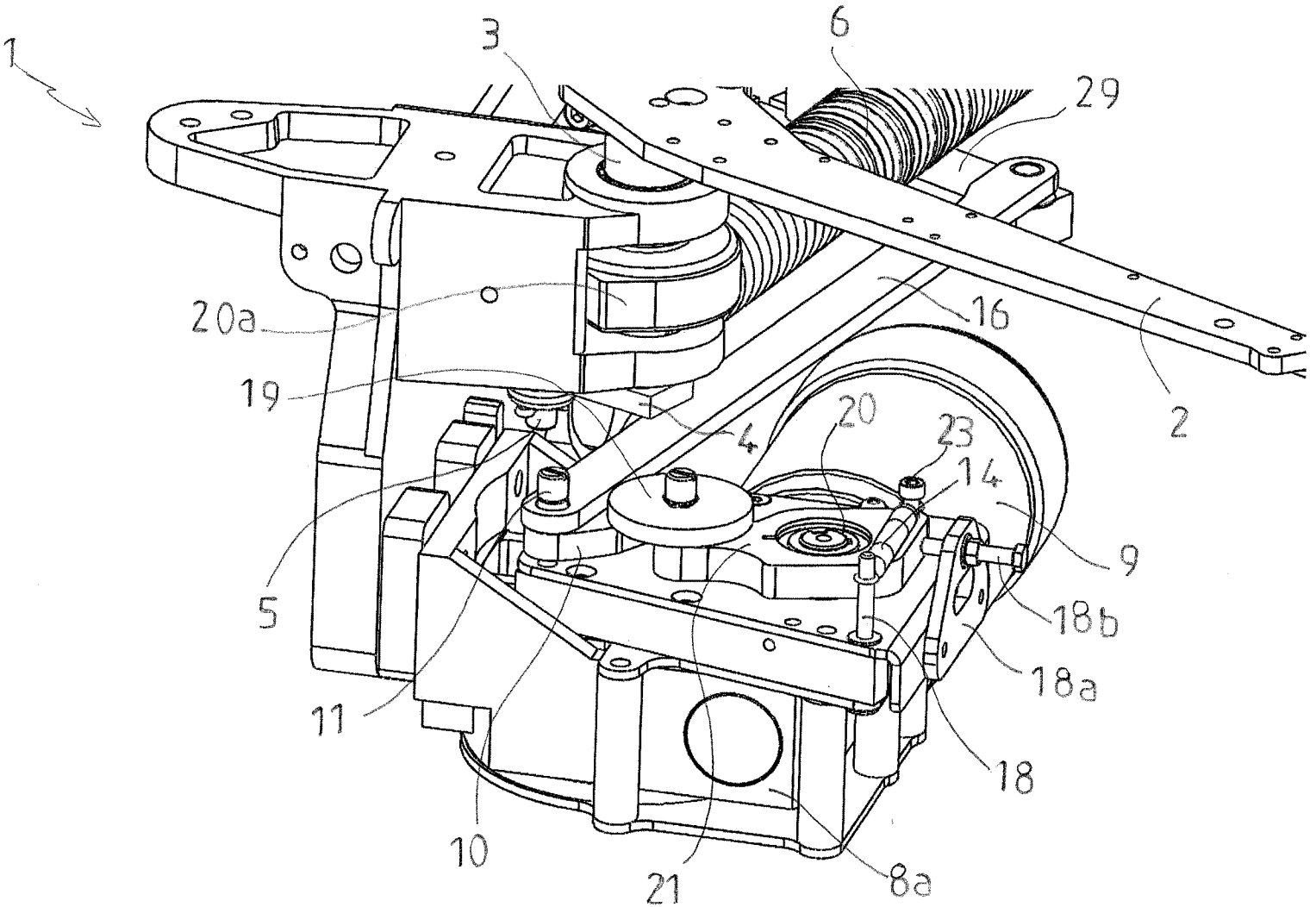

As can be seen specifically in FIGS. 2 and 3, the first crank pin 10 belonging to such embodiments of the first locking means 10, 11 mentioned above, carries, at the periphery thereof, a first pinion 25, preferably at the second end of the crank pin 10. The first pinion 25 is advantageously positioned on the lower part of the crank pin 10 and supported by the upper face of the lower portion 8*a* formed by a plate supporting the device 1 body.

The pinion 25 of the first crank pin 10 is driven by the gear motor 9. The first pinion 25 drives a second pinion 26 which in turns engages a third pinion 27. The second pinion 26 is an intermediary pinion and is not compulsory. The third pinion 27 is associated with a second crank pin 21 which belongs to the second locking means according to the present invention which shall be described in greater details in the following.

The embodiments illustrated in FIGS. 4 to 11 may also show first, second and third pinions, although these are not visible. Such pinions may also be placed under a plate supporting the first and second crank pins 10, 21.

In the embodiments shown in FIGS. 2 to 11, the first crank pin 10 belonging to the first locking means is provided with a first stop, advantageously in the form of a nipple 11. The nipple 11 pushes the complementary locking means 5, here the nipple 5 carried by the connecting rod 4 in a position corresponding to the <<zero point>> position of the arm 2 during the step of cocking the arm. This can be seen specifically in FIGS. 5 and 6.

The third pinion 27, which is shown in FIGS. 2 and 3, is linked to an axis 22 which extends parallel to the shaft 3 carrying the arm 2. Such axis 22 carries a free wheel 20 at the upper extension thereof above the third pinion 27. The free wheel 20 is included in the second crank pin 21, the end of which is preferably provided with a freely rotating roller 19. In this embodiment, such elements belong to the second locking means 19, 20, 21 according to the present invention. The roller 19 forms the second stop and holds the complementary locking means 5 in the position thereof corresponding to the so-called arm 2 launching position, i.e. slightly beyond or equivalent to the <<zero point>> position prior to releasing these upon rotation of the third pinion 27.

The first and second crank pins 10, 21 may comprise a first end respectively carrying a pinion 25, 27. The stop, as a nipple 11 or a roller 19, respectively carried by the first and second crank pins 10, 21 is preferably arranged at a second end of the crank pin 10, 21 opposite the first end carrying the pinion 25, 27. As regards the second locking means 19, 20, 21, the free wheel 20 of the second crank pin 21 is preferably arranged at the first end. A bar 16, one end of which surrounds the nipple 11, advantageously connects it to the upper portion 8 of the device 1 body, as can be specifically seen in FIG. 11. Such bar 16 does not act on the triggering mechanism. A link synchronizes the rotation of a barrel containing targets and thus the loading of a target for the launching with the position of the arm 2. Upon starting of the motor, the arm 2 is accelerated and rotates by 270°. The crank pin 10 then starts moving, and, over the first 180°, it cooperates with the lower part of a connecting rod 29, using the bar 16. The other end of the connecting rod 29 is in contact with the barrel and causes the clockwise rotation thereof until a target falls onto a launching plate. The next 180° reset the position of the connecting rod 29 by causing the rotation thereof anticlockwise. During such phase, the nipples 5 and 11 come in contact until the zero point is past by the nipple 5, in the coking position.

The first locking means 10, 11 rather aim at guiding the complementary locking means 5 mainly through the nipple 11 upon the rotation of the first crank pin 10 driven by the pinion thereof 25 towards the position matching the <<zero point>> position of the arm 2 and, if need be, slightly beyond such <<zero point>> position whereas the second locking means 19, 20, 21 gradually hold the complementary locking means 5 in the <<zero point>> position and the passing past thereof towards a launching position, so long as the target has not been called.

Then, with the restarting of the motor means 9 which stopped upon reaching the launching position, the second locking means 19, 20, 21 are immediately unlocked and the nipple 5 and further on the rotating shaft 3 and the arm 2, are immediately released, with the latter then rotating to launch the target.

Advantageously, the first and second locking means 10, 11, 19, 20, 21 and the complementary locking means 5 are positioned under the arm 2 rotating shaft 3. They do not directly act on the arm 2 and do not interfere therewith, unlike some devices of the prior art.

Opposite the free roller 19, the second crank pin 21 carries a lug 17 supporting a rod 23 positioned above and raised with respect to the lug 17, and possibly provided with a roll at the free upper end thereof.

Another part of the second crank pin 21, or preferably the lug 17 is pushed towards an element 18*a* linked to the lower portion 8*a* of the body, in one position of the free wheel 20. The element 18*a* may be provided with an adjusting screw 18*b*, particularly clearly visible in FIGS. 4 to 10, so as to adjust the space between the element 18*a* and the second crank pin 21.

Elastic means, i.e. a return spring 14, extends while being linked, on the one hand, to the rod 23 supported by the lug 17 of the second crank pin 21 and, on the other hand, to the upper end portion of a rod 18 extending substantially vertically and resting on the lower portion 8*a* of the device 1 body. Such return spring 14 returns the rod 23 and thereby the second crank pin 21 against the element 18*a*, specifically against the free end of the screw 18*b* going therethrough. Other embodiments of the return of the second crank pin 21 against the element 18*a* are possible too, with the element 18*a* having other shapes, for instance.

The free end 20, positioned inside the second crank pin 21, is permissive clockwise and does not hinder the return motion of the return spring 14.

As mentioned above for a launching device of the prior art, a contactor 12 may be provided and located substantially above the vicinity of the engagement of the draw-spring 6 with the upper portion 8 of the device 1 body, at one end of said draw-spring 6. A part of such contactor 12 may match the trajectory of a portion of the arm 2 when the arm 2 has rotated about its axis, with such portion being advantageously the free end portion of the arm 2, with such free end portion of the arm 2 carrying an element complementary to the contactor 12. The contactor 12 is so positioned as to trigger the stopping of the gear motor 9 when the launching position of the arm 2 is reached, advantageously the <<zero point>> position or a position slightly beyond the <<zero point>> position.

In operation, the nipple 11 of the first crank pin 10, actuated by the gear motor 9, pushes the nipple 5 of the connecting rod 4 until it goes beyond a position corresponding to the launching position of the arm 2 mentioned above. In such launching position, the contactor 12 then comes in contact with the arm 2 and stops the gear motor 9. The nipple 5 is in contact with the roller 19 of the second crank pin 21 so that the roller 19 is forced counter-clockwise and prevents the arm 2 from launching a target.

Just as a triggering device starts the gear motor 9, the rotation of the shaft 22 releases the free wheel 20 and causes the rotation of the crank pin 21 counter-clockwise. The second locking means 19, 20, 21 then release the complementary locking means 5 and the arm 2 can freely rotate to launch a target.

The method for launching a target using such a launching device 1 may comprise the following steps.

Figure 5:
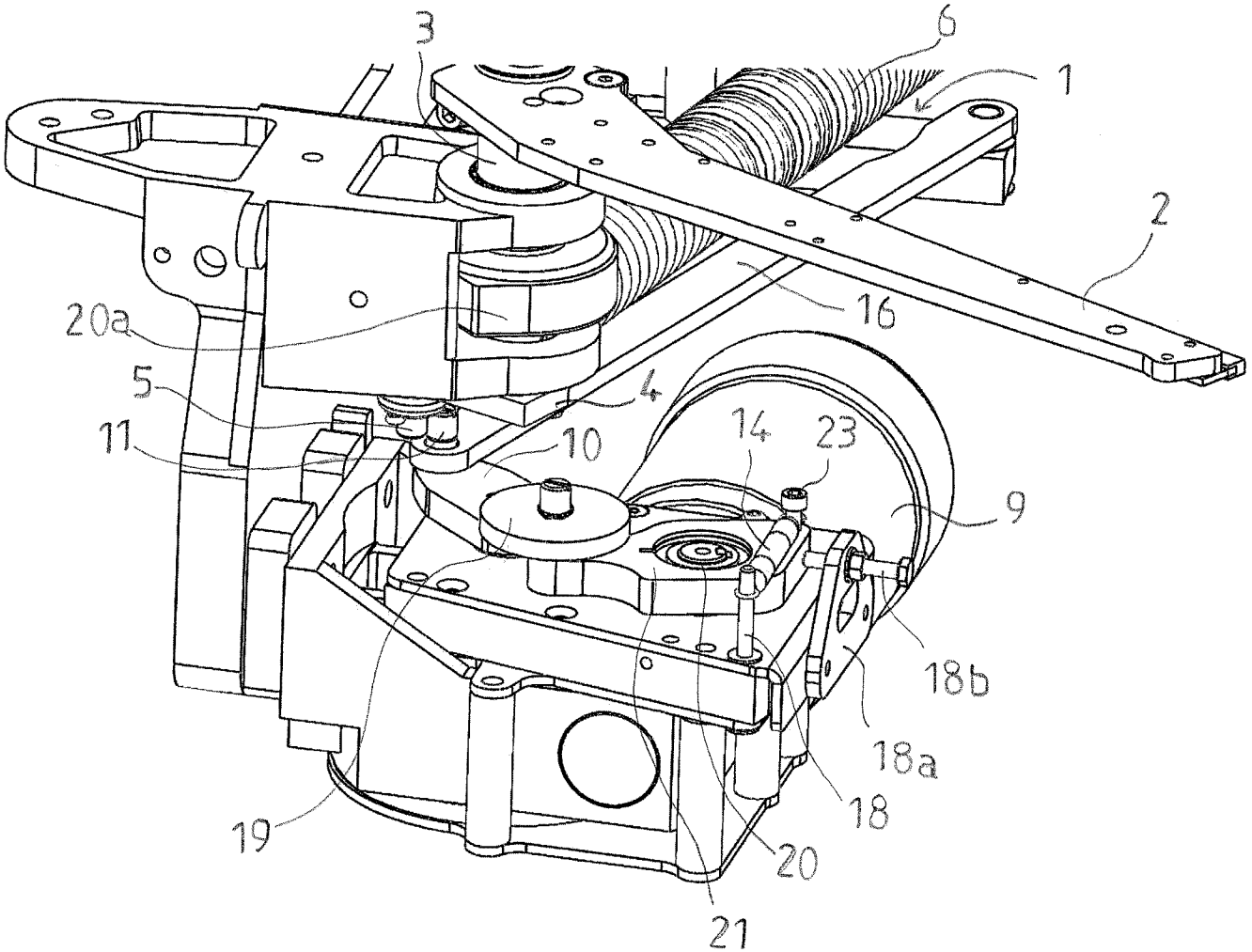
Figure 6:
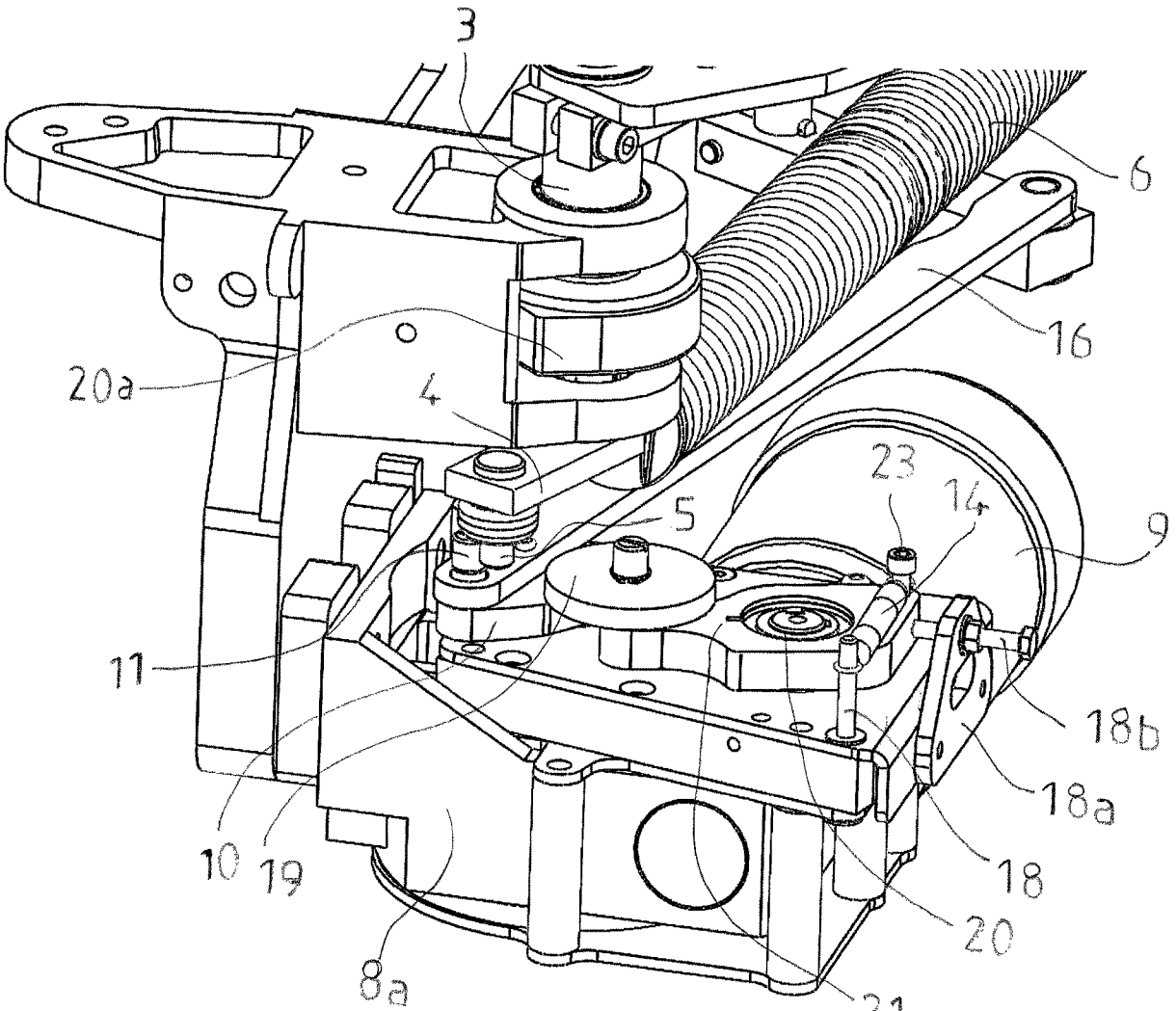
Figure 7:
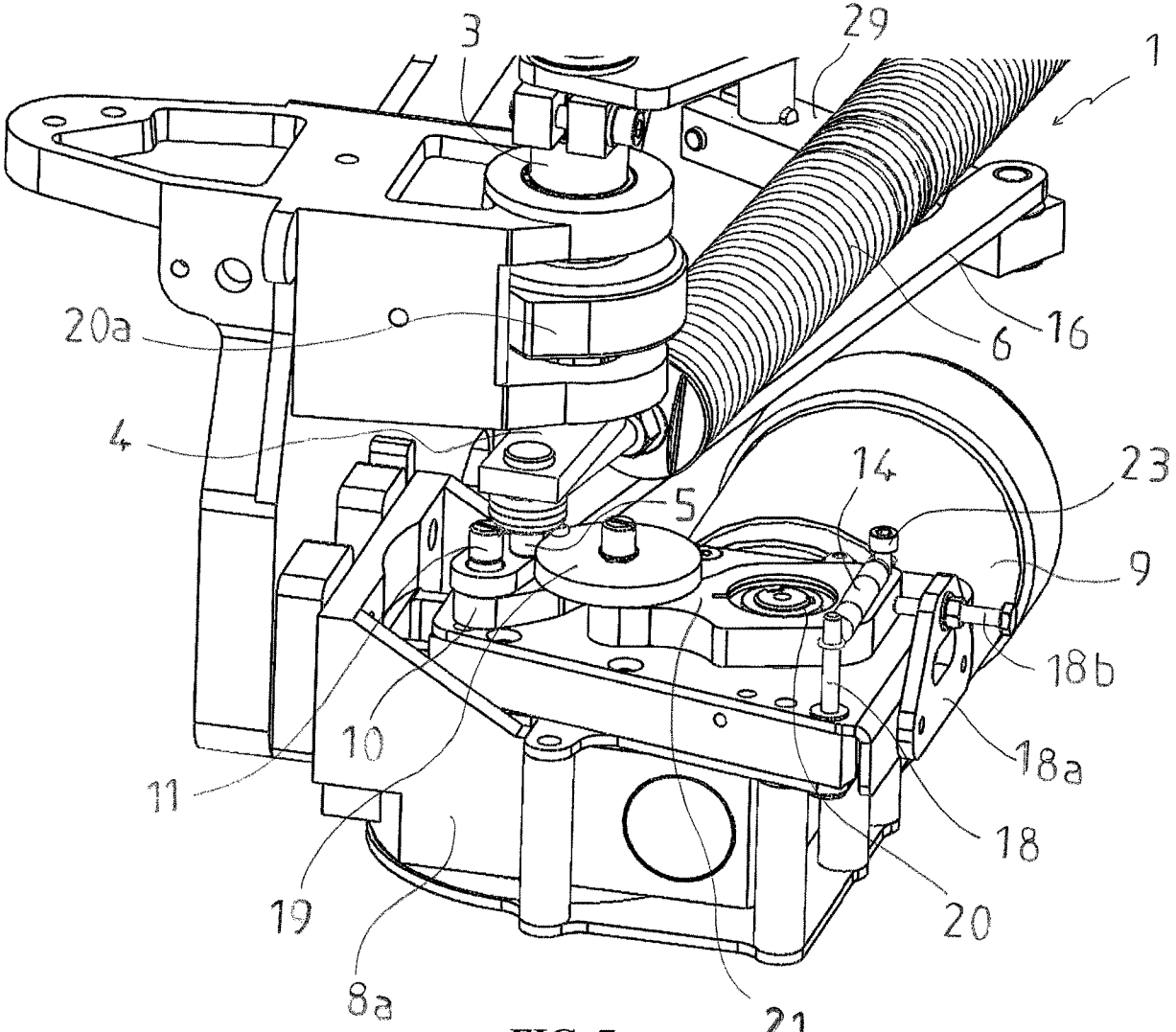
Figure 8:
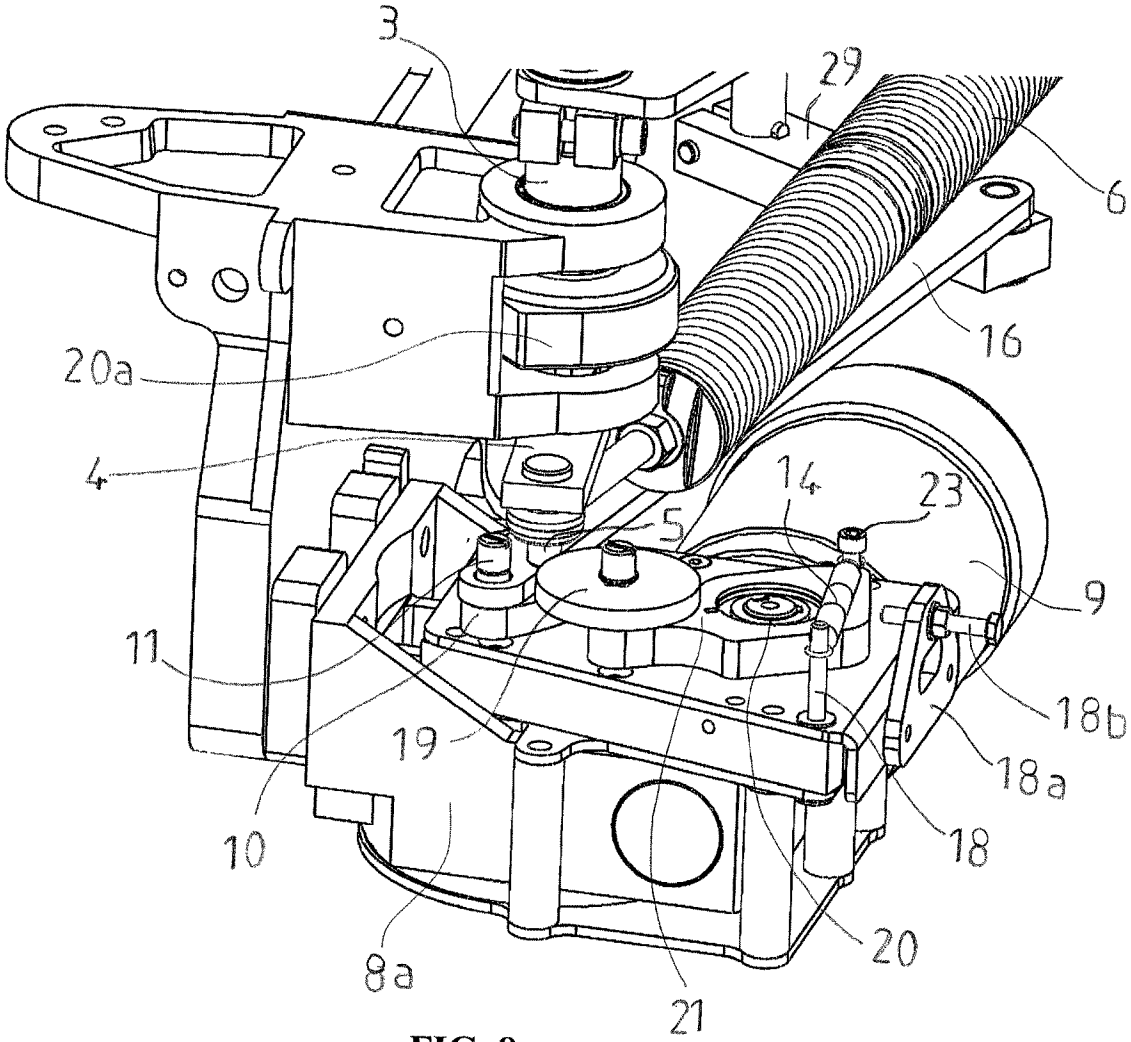
Figure 9:
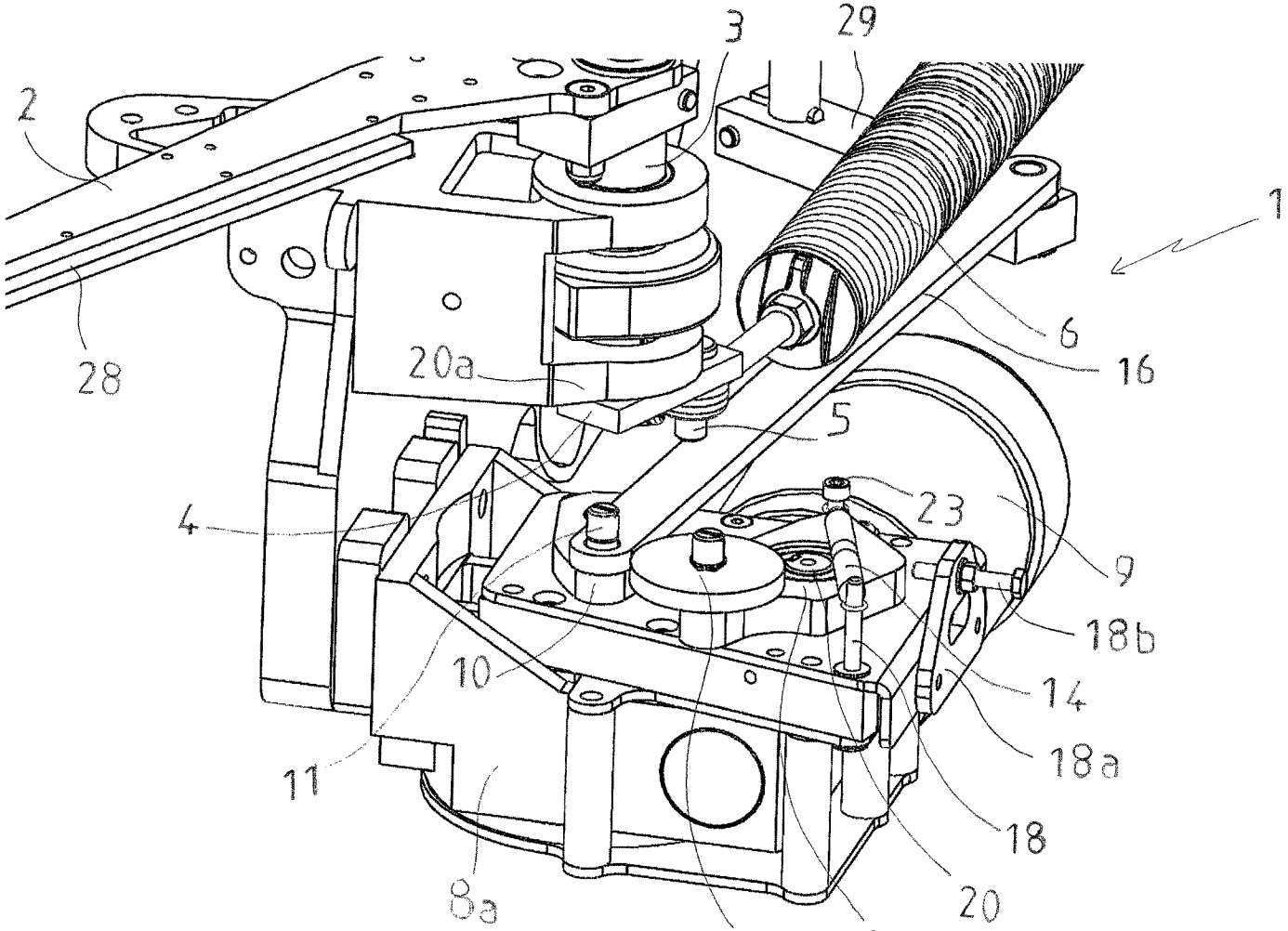
Figure 10:
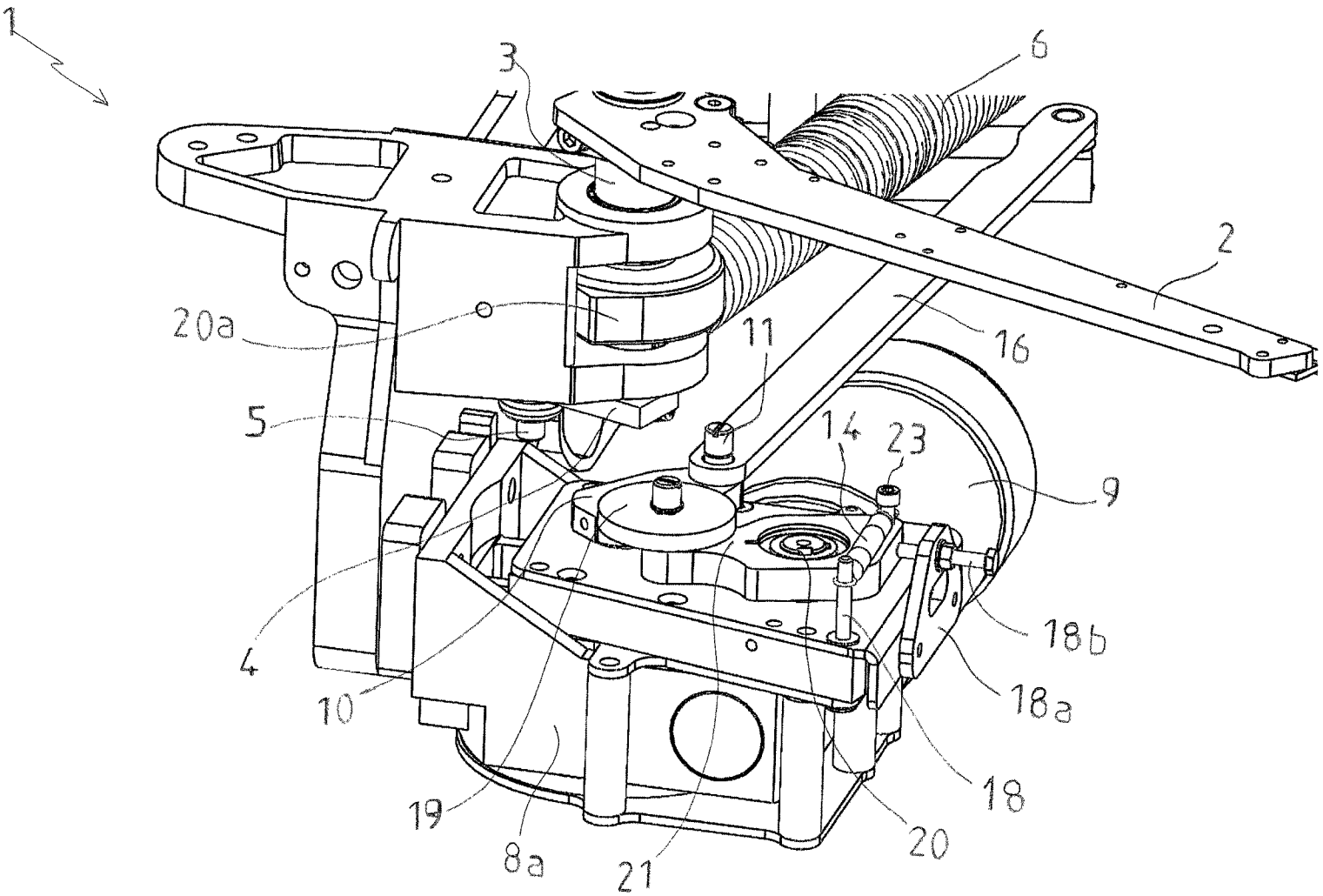

The first step consists in cocking the launching means 6 by rotation of the arm 2 driven by the motor means 9 up to the "zero point", The first step may be more particularly illustrated by FIGS. 5 and 6. During the step of cocking, the first locking means 10, 11 and more specifically the nipple 11, push the complementary locking means, advantageously the nipple 5, to the <<zero point>> position.

The second step consists in driving the arm 2 up to the launching position beyond or equivalent to the <<zero point>> in the direction of rotation of the arm 2. The first locking means 11 keep pushing the complementary locking means 5 carried by the arm 2 rotating shaft 3 to a launching position slightly beyond or equivalent to the "zero point" position. During this step, the second locking means 19, 20, 21 gradually become active to lock the nipple 5 and thereby to prevent any rotation of the arm 2 rotating shaft 3.

Figure 11:
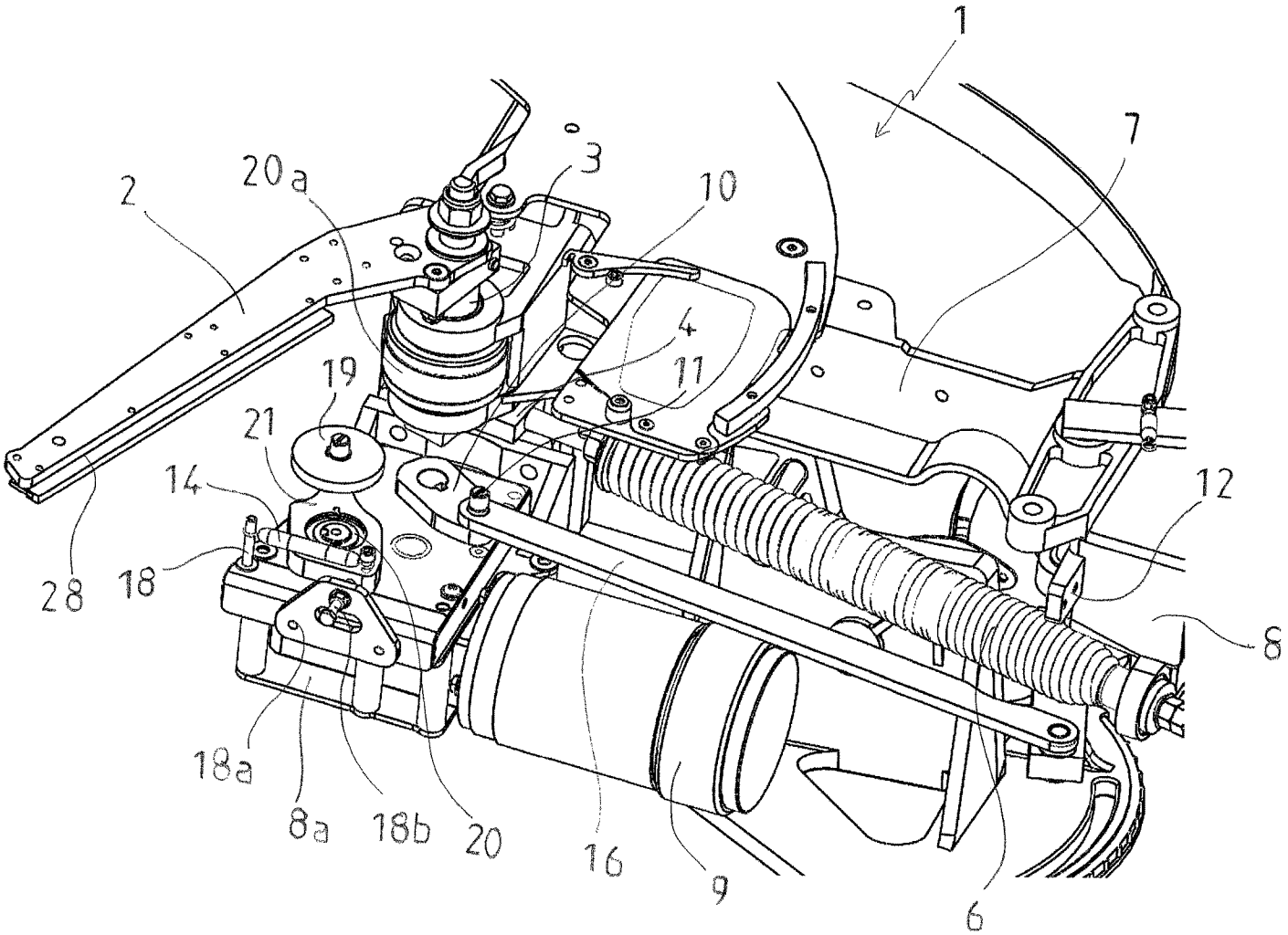

The third step consists in stopping the motor means 9 after detecting that the "zero point" position has been gone past, and that the arm is in the launching position. Such detection may be executed by a contactor 12 as shown in FIG. 11.

The fourth step consists in locking the arm 2 in the launching position, while keeping the launching means 6 under traction, For this purpose, the second locking means 19, 20, 21 hold the complementary locking means 5 in a position corresponding to the launching position.

The fifth step corresponds to the restarting the motor means 9 further to a target call so as to unlock the arm 2. The launching of the target by the arm 2 is then executed by releasing the launching means 6 further to the release of the complementary locking means 5 by the second locking means 19, 20, 21.

Because of the inertia of the system, the arm stops rotating at about 270° from the so-called "zero point" position. Holding such position at 270° is possible thanks to the free wheel 20*a* provided on the arm 2 rotating shaft 3. With the gear motor 9 operating on, the free wheel 20*a* becomes driving again and drives the connecting rod 4 again for a new step of cocking.

According to the invention, there is no timing problem since the gear motor 9 only is acted upon, with the locking and release system being mechanically linked thereto. The electrical control is thus simplified and risks of malfunction are reduced. Only a defective draw-spring 6 could lead to a burst start of the arm 2. The safety of persons near the device 1 is thereby significantly improved as compared to the embodiments of the prior art, such as the one shown in FIG. 1.

REFERENCES

1. device
1*a*. device
2. arm
3. shaft
4. connecting rod
5. nipple
6. draw-spring
7. cross-piece
8. upper portion
8*a*. lower portion
9. gear motor
10. first crank pin
10*a*. crank pin
11. nipple
12. contactor
13. trigger
14. return spring
15. electromagnet
16. bar
17. lug
18. rod
18*a*. element
18*b*. adjusting screw
19. roller
20. free wheel
20*a*. free wheel
21. second crank pin
22. axis
23. rod
24. cross-piece
25. first pinion
26. second pinion
27. third pinion
28. fixture
29. connecting rod
A1. Axis

The invention claimed is:

1. A target launching device comprising:

a rotationally mobile arm, a launcher, and a motor configured to cock the arm by rotating said arm and a rotating shaft up to a zero point position, wherein the launcher and the motor are acting on said rotating shaft, wherein the launcher is under traction without exerting a torque on said arm in said zero point position, the device comprising a first element and a second element differing from the first element, with the first element and the second element being configured to lock a rotation of the arm and both driven by the motor and so configured as to contact a complementary locker inserted between the launcher and the rotating shaft, with the first element and the complementary locker being so configured as to push the arm up to a launching position beyond the zero point position over a predetermined angular sector according to a direction of rotation of the arm, wherein the second element and the complementary locker are so configured as to lock the arm in the launching position in a first relative position of the second element and the complementary locker, wherein the second element contacts the complementary locker, and so as to release the arm beyond the launching position the second element and the complementary locker are in a second relative position wherein the second element does not contact the complementary locker, wherein the launcher is configured to relax in order to operate the rotation of the arm for launching a target when the second element and the complementary locker are in the second relative position, wherein the launcher comprises a draw-spring adapted to be tensioned upon rotation of the arm to the zero point position, with a return of the draw-spring to an expanded position being so configured as to perform the rotation of the arm for launching the target, and wherein the draw-spring is fixed, at one end thereof, to a stationary portion of the device, with another end thereof being hinged at one end of a connecting rod, another end of the connecting rod being linked to the rotating shaft, with the connecting rod carrying the complementary locker.

2. The device according to claim 1, wherein the first and second elements and the complementary locker are positioned under the rotating shaft.

3. The device according to claim 1, wherein the first and second elements respectively comprise a first stop so configured as to push the complementary locker carried by the connecting rod to a position corresponding to the launching position of the arm and a second stop so configured as to hold such complementary locker in said position.

4. The device according to claim 3, wherein the motor comprises a gear motor.

5. The device according to claim 4, comprising a first crank pin so configured as to be driven by the gear motor and carrying the first stop, a second crank pin mounted on a free wheel and carrying the second stop, with said free wheel allowing the second crank pin to rotate in a direction of rotation opposite that of the gear motor.

6. The device according to claim 5, wherein the first and second crank pins each comprise a first end respectively carrying a pinion and a second end opposite the first end respectively carrying a stop, with the free wheel being arranged at the first end of the second crank pin.

7. The device according to claim 6, wherein the pinion of the first crank pin is so configured as to be driven by the gear motor and in turn to drive the pinion of the second crank pin directly or indirectly.

8. The device according to claim 7, comprising an intermediary pinion inserted between the pinion of the first crank pin and the pinion of the second crank pin, with the intermediary pinion being driven by the pinion of the first crank pin and driving the pinion of the second crank pin.

9. The device according to claim 6 wherein the second crank pin comprises a rod mounted against a spring so configured as to push the second crank pin against a stationary element.

10. The device according to claim 5, wherein the first stop carried by the first crank pin and the complementary locker are each in the form of a nipple and the second stop carried by the second crank pin is in the form of a roller.

11. The device according to claim 1, comprising a contactor so positioned as to trigger the stopping of the motor once the launching position of the arm is reached.

12. The device according to claim 11, wherein the contactor is positioned on an upper portion of a stationary body of the device so as to interact with a free end of the arm the free end carrying a complementary element to the contactor.

13. The method for launching a target using a launching device according to claim 1, with said method comprising the following successive steps:

cocking the launcher by rotating the arm driven by the motor to the zero point, with the first element pushing the complementary locker carried by the rotating shaft in a position corresponding to the zero point position, driving the arm to the launching position beyond the zero point according to the direction of rotation of the arm, with the first element pushing on the complementary locking means carried by the connecting rod being linked to the rotating shaft in the launching position, stopping the motor, locking the arm in the launching position, while keeping the launcher under traction, with the second element and the complementary locker being in the first relative position, restarting the motor, further to a target call so as to unlock the arm, and launching the target by the arm by releasing the launcher by moving the second element and the complementary locker from the first relative position to the second relative position.

14. The launching method according to claim 13, wherein the stopping of the motor follows a detection of a position of the arm corresponding to the zero point.

15. The launching method according to claim 13, comprising a step of holding the arm in a final position in rotation thereof, after launching, with said final position being a starting position for a step of cocking a new launching cycle.

* * * * *